US009114441B2

(12) United States Patent
Hughes et al.

(10) Patent No.: US 9,114,441 B2
(45) Date of Patent: Aug. 25, 2015

(54) HANDHELD NOZZLE CLEANING APPARATUS

(71) Applicants: William C. Hughes, Woodstock, IL (US); Jason A. Pilman, Crystal Lake, IL (US)

(72) Inventors: William C. Hughes, Woodstock, IL (US); Jason A. Pilman, Crystal Lake, IL (US)

(73) Assignee: Innoquest, Inc., Woodstock, IL (US)

( * ) Notice: Subject to any disclaimer, the term of this patent is extended or adjusted under 35 U.S.C. 154(b) by 153 days.

(21) Appl. No.: 13/912,280

(22) Filed: Jun. 7, 2013

(65) Prior Publication Data

US 2013/0333157 A1 Dec. 19, 2013

Related U.S. Application Data

(60) Provisional application No. 61/689,871, filed on Jun. 14, 2012.

(51) Int. Cl.

| | |
|---|---|
| ***B08B 5/02*** | (2006.01) |
| ***B08B 9/032*** | (2006.01) |
| ***B05B 15/02*** | (2006.01) |
| ***B05B 12/12*** | (2006.01) |
| ***B05B 1/00*** | (2006.01) |
| ***F04B 33/00*** | (2006.01) |

(52) U.S. Cl.

CPC ..... *B08B 9/0328* (2013.01); *B05B 1/005* (2013.01); *B05B 12/122* (2013.01); *B05B 15/0258* (2013.01); *B08B 5/02* (2013.01); *F04B 33/00* (2013.01)

(58) Field of Classification Search

USPC ..... 15/406, 407, 344, 329, 330, 345, 416, 15/341, 405; 92/8, 13, 15, 20, 23, 30

See application file for complete search history.

(56) References Cited

U.S. PATENT DOCUMENTS

| | | | | |
|---|---|---|---|---|
| 3,851,352 | A * | 12/1974 | Hibberd et al. | 15/341 |
| 3,862,468 | A * | 1/1975 | Fortune | 15/341 |
| 3,921,249 | A * | 11/1975 | Fortune | 15/341 |
| 5,187,833 | A * | 2/1993 | Bieganski | 15/341 |
| 6,325,601 | B2 * | 12/2001 | Wu | 417/469 |
| 6,508,161 | B2 * | 1/2003 | Suzuki et al. | 92/23 |
| 6,921,254 | B2 * | 7/2005 | Wu | 417/569 |

* cited by examiner

*Primary Examiner* — Dung Van Nguyen

(74) *Attorney, Agent, or Firm* — Reinhart Boerner Van Deuren P.C.

(57) ABSTRACT

A handheld nozzle cleaning device includes a cylinder and piston disposed within the cylinder. The piston is movable between a latched position, in which air is compressed, and an unlatched position, in which air is drawn into the cylinder. The handheld nozzle cleaning device also includes a valve and a nozzle disposed at one end of the cylinder. Manual operation of the piston, defined by linear movement of the piston in a first direction, both releases the piston from the latched position and draws air into the cylinder. The compressed air flows out of the cylinder through the nozzle when the valve is opened. Also, manual operation of the piston in a second direction opposite the first direction both compresses air within the cylinder and secures the piston in the latched position.

17 Claims, 4 Drawing Sheets

SECTION A-A

HANDHELD NOZZLE CLEANING APPARATUS

CROSS-REFERENCE TO RELATED PATENT APPLICATIONS

This patent application claims the benefit of U.S. Provisional Patent Application No. 61/689,871 filed Jun. 14, 2012, the entire teachings and disclosure of which are incorporated herein by reference thereto.

FIELD OF THE INVENTION

The present invention generally relates to handheld cleaning tools. More particularly, the present invention relates to handheld cleaning tools for clearing debris from liquid application nozzles.

BACKGROUND OF THE INVENTION

Liquid application nozzles are commonly used in the application of water and chemicals in a wide variety of industries including but not limited to farming, agriculture, food processing, and industrial plants. Typically, a liquid application nozzle has a specially shaped internal orifice that causes the liquid forced through the nozzle to discharge in a pattern that distributes the liquid over a desired area. These are commonly referred to as spray nozzles, spray tips, sprayer nozzles, sprayer tips, or irrigation nozzles when referring to agricultural applications. During use, it is not uncommon for debris or foreign material to get lodged in the nozzle's orifice as the liquid is passing through the nozzle. Such debris can be introduced into the system's internal plumbing from corrosion, buildup, or poor quality liquid ingredients. Once debris partially or fully plugs a nozzle's orifice, the flow rate and distribution pattern are affected, and reduce the performance of the liquid application system.

Conventional practice involves removal of the nozzle from the supply piping and subsequently debris is removed from the nozzle by a one or more of the following methods. A brush is dragged across the nozzle to loosen the debris. Alternatively, the nozzle is tapped against a hard surface such that sudden impact with the hard surface causes the debris to break loose from the orifice. Alternatively, the nozzle is held up near one's mouth and an attempt is made to blow air through one's lips fast enough to dislodge the debris and clear the nozzle. The methods listed above are only moderately effective and can be difficult to accomplish with small nozzles, or when one is wearing rubber gloves for safety.

Given some of the above-mentioned problems associated with cleaning of liquid application nozzles, a more effective method of cleaning the nozzles involves using a blast of compressed gas passed backwards through the nozzle's orifice to dislodge the debris and eject it from the nozzle. For example, the compressed gas can be supplied from a hose attached to an air compressor, or produced from a small refillable or replaceable tank containing an aerosol or $CO_2$-type propellant.

As is often the case with agricultural applications they are in farm fields where an air compressor and hose are not portable enough and therefore not a convenient option thus leaving the small cans of propellant as the best solution for this type of field application. When new the cans of propellant are convenient and effective but eventually the propellant becomes depleted and must be recharged or replaced. This becomes very inconvenient when in an agricultural field or under time constraints and trying to solve plugged nozzle problems quickly.

It would therefore be desirable to have a handheld portable apparatus which produces a blast of compressed gas for clearing debris from nozzles that does not require refilling or replacement of tanks or cans. It would also be desirable if the compressed gas was air and therefore would never require any maintenance to the gas supply.

Embodiments of the invention provide such an apparatus. These and other advantages of the invention, as well as additional inventive features, will be apparent from the description of the invention provided herein.

BRIEF SUMMARY OF THE INVENTION

Embodiments of the present invention produce a blast of compressed air for clearing debris from the orifice of liquid application nozzles. Furthermore, embodiments of the present invention function by compressing a volume of ambient air to a pressure sufficiently greater than ambient pressure. The charge of compressed air is held in a chamber in until released through a valve activated by the user. The compressed air then discharges through a nozzle which focuses the air into the orifice which is to be cleaned.

Embodiments of the present invention provide a means of compressing the air by forcing a piston down a cylinder with a closed end. This compression is accomplished with a single stroke of the piston and is powered manually by the user therefore requiring no other power source such as batteries, liquefied compressed gas, or combustion of fuel. Once fully compressed a self activating latch holds the piston in the compressed position.

Embodiments of the present invention provide a means of releasing the compressed air through a valve which can be activated by a light pressing action from the user's finger. The valve has a nozzle attached which directs the released air toward the orifice being cleaned. The self activating latch functions to hold the piston in the compressed position until a release knob is pulled. The action of pulling the release knob not only releases the self activating latch but acts to pull the piston from the cylinder as the pulling action is continued. In this way the user's action of pulling on the piston to extend it serves a dual function of releasing the latch to allow free piston movement as well as extending the piston to ready if for producing another charge of compressed air.

Particular embodiments of the present invention provide a device that maximizes the compression stroke of the piston through the cylinder by containing the compressed air inside a hollow cavity in the piston rod when the compression stroke is complete. In this way the full length of the cylinder is used for compression since the head of the piston moves the entire length.

In one aspect, embodiments of the invention provide a handheld nozzle cleaning device includes a cylinder and piston disposed within the cylinder. The piston is movable between a latched position, in which air is compressed, and an unlatched position, in which air is drawn into the cylinder. The handheld nozzle cleaning device also includes a valve and a nozzle disposed at one end of the cylinder. Manual operation of the piston, defined by linear movement of the piston in a first direction, both releases the piston from the latched position and draws air into the cylinder. The compressed air flows out of the cylinder through the nozzle when the valve is opened. Also, manual operation of the piston in a second direction opposite the first direction both compresses air within the cylinder and secures the piston in the latched position.

In particular embodiments, a spring biases the valve in a closed position. Further, the cylinder, valve, spring, and nozzle may all be aligned axially. The valve is opened when a force sufficient to overcome the biasing force of the spring is applied to the nozzle in the axial direction. In an embodiment, the cylinder has an opening at the one end, the nozzle having a valve stem, configured to move within the opening, and a boss configured to cover the opening when the valve is in the closed position.

In a further embodiment, the nozzle has a passage that permits a flow of air from the valve stem out through an end of the nozzle when the valve is in the open position. The opening, valve stem, and boss may be centered on a longitudinal axis of the cylinder and piston. The cylinder has one or more openings therein, and wherein manual operation of the piston draws air from outside of the cylinder through the one or more openings into the cylinder. The piston may be hollow, such that manual operation of the piston compresses air within the piston.

In a particular embodiment, the piston includes a piston head that forms an air-tight seal within the cylinder. Furthermore, a vent hole in the cylinder allows for air into the cylinder when the piston head is not sealing against the vent hole. The air-tight seal may be maintained by an O-ring inserted into a groove in the piston head.

In certain embodiments, a latching mechanism is configured to keep the piston in place when compressed air is in the cylinder. In particular embodiments, the latching mechanism includes a hand knob, a bushing, and latching prongs attached to an end of the piston, wherein the hand knob is adapted to operate the piston for compressing air in the cylinder. The latching prongs may be configured to be flexed inward by movement of the hand knob, and also configured to extend through an opening in a cylindrical portion of the hand knob such that the latching prongs contact a portion of the bushing to keep the piston in place. In certain embodiments, the bushing is attached to an end of the cylinder opposite the end with nozzle. In a further embodiment, the piston is sized to fit completely inside of the cylinder when air is compressed in the piston.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
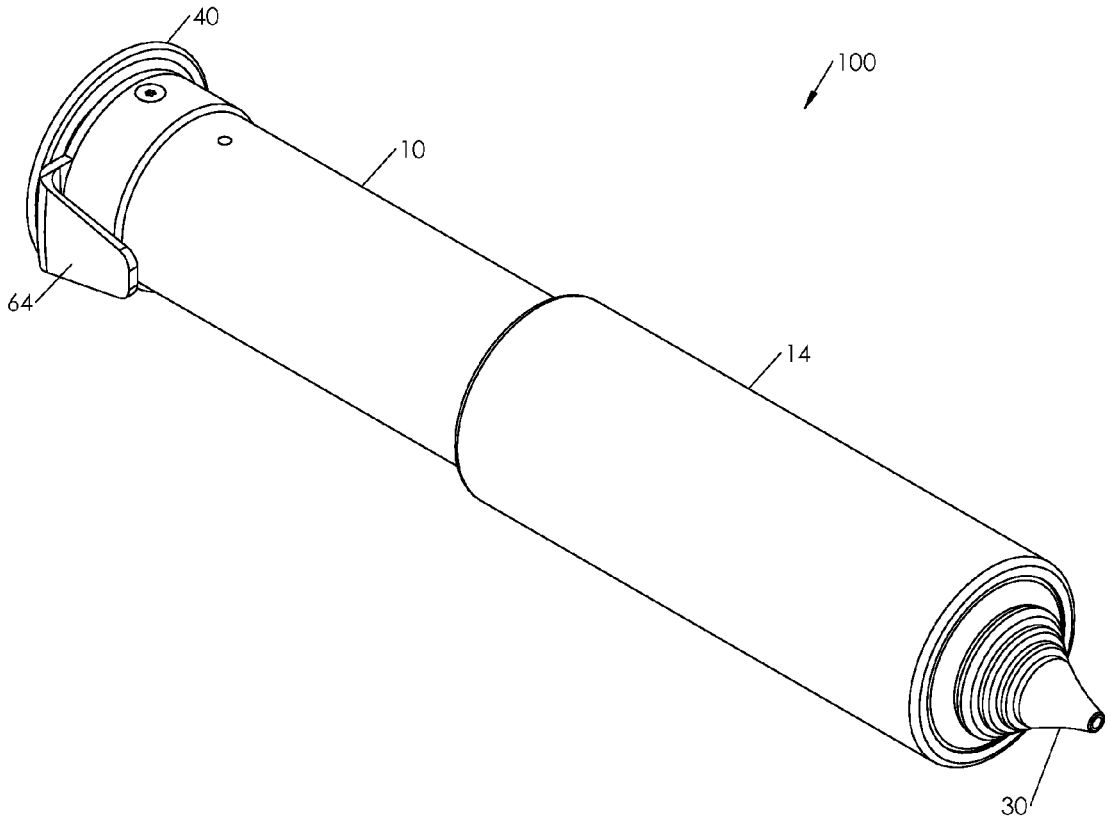
FIG. 1 is a perspective view of a handheld nozzle cleaning apparatus, constructed in accordance with an embodiment of the invention.
Figure 2:
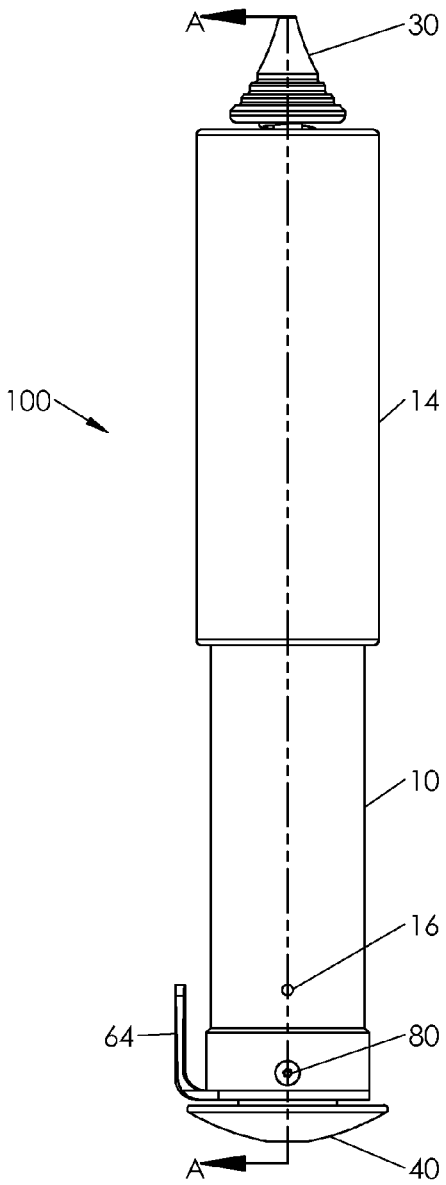
FIG. 2 is a side view of the handheld nozzle cleaning apparatus of FIG. 1.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

A nozzle-cleaning apparatus 100 for cleaning nozzles, constructed in accordance with an embodiment of the invention, is shown in FIGS. 1-7. The apparatus 100 includes a cylinder 10 and a piston 20. A valve and nozzle 30 is attached to the closed end 11 of cylinder 10. A latch mechanism 400 is attached to one end of piston 20. A hand knob 40 which also acts as a release for latch mechanism 400 is attached to the latch mechanism end of piston 20. The entire nozzle cleaning apparatus 100 is sized to be held and operated in one hand of the user. Valve and nozzle 30 functions to release the charge of compressed air when depressed by one of the user's fingers. The cylinder 10 and piston 20 are centered on a longitudinal axis 301. In a particular embodiment, the valve and nozzle 30 are also centered on longitudinal axis 301.

Figure 5:
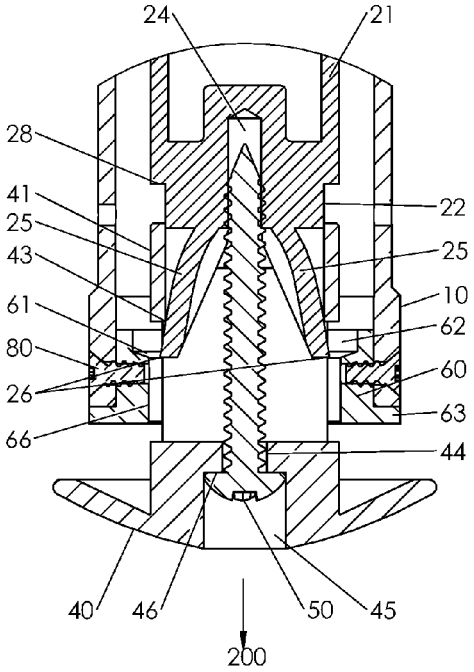
FIG. 5 is a close up section detail view of the handheld nozzle cleaning apparatus of FIG. 1 with piston unlatched.

Operation of the handheld nozzle cleaning apparatus 100 is as follows. The user grasps cylinder body 10 in one hand at the location of hand grip 14. The user may then hold hand knob 40 with fingers of the other hand in a manner that allows a pulling force in the direction of 200 on hand knob 40. Such pulling force 200 on hand knob 40 causes hand knob 40 to slide along portion 22 of piston 20 until the edges 43 of hand knob 40 come in contact latch prongs 25. As pulling force 200 on hand knob 40 continues, edges 43 of hand knob 40 slide along latch prongs 25 and cause latch prongs 25 to be flexed inward until the tips 26 of latch prongs 25 are flexed, as shown in FIG. 5, such that they no longer protrude beyond the outer diameter of portion 41 of hand knob 40. As this occurs, the head of screw 50 comes in contact with the seat 46 of hand knob 40 to limit further movement of hand knob 40 along portion 22 of piston 20.

Figure 7:
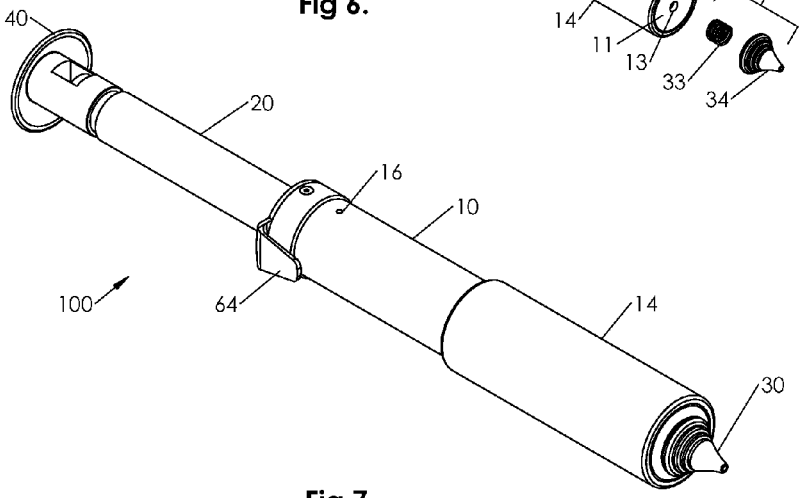
FIG. 7 is a perspective view of handheld nozzle cleaning apparatus of FIG. 1 with piston extended.

Further inward, flexing of latch prongs 25 is therefore stopped and pulling force 200 on hand knob 40 is now transferred to a pulling force on piston 20 through screw 50. Since the tips 26 of latching prongs 25 are no longer protruding beyond the outer diameter of portion 41, piston 20 is free to slide through the inner diameter 66 of bushing 60. Pulling force 200 is continued on hand knob 40 until the piston head 27 is in contact with bushing 60, which acts as a stop and notifies the user that the pulling operation is complete. FIG. 7 shows handheld nozzle cleaning apparatus 100 in this fully extended state. At this point, piston head 27 has passed vent hole 16 in cylinder 10 allowing ambient air to enter cylinder 10 above piston head 27 until the air pressure inside cylinder 10 matches that of ambient.

Figure 4:
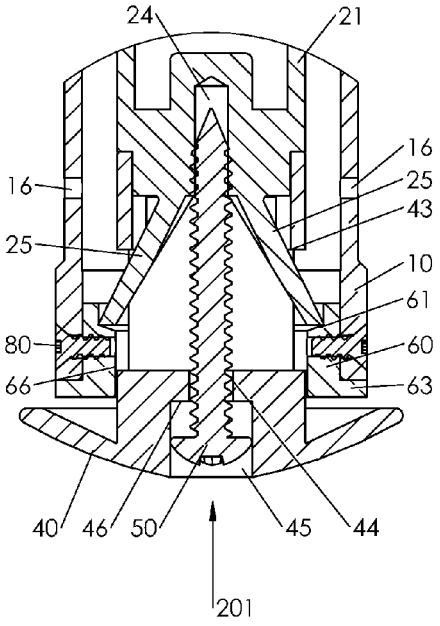
FIG. 4 is a close up section detail view of the handheld nozzle cleaning apparatus of FIG. 1 with piston latched.

Referring to FIGS. 4 and 5, the next phase of operation of the handheld nozzle cleaning apparatus 100 is to compress the air inside cylinder 10 above ambient and contain it for future use. This is accomplished by applying a pushing force 201 on hand knob 40, which causes portion 41 to slide forward until it contacts a shoulder 28 on piston rod 21. As hand knob 40 moves forward, edges 43 no longer make contact with latching prongs 25 and allow them to return to their normal non-deformed state such that their outer tips 26 move back into their original position taking a position with an effective outer diameter greater than the inside diameter 66 of bushing 60.

As the pushing force 201 is continued on hand knob 40, piston 20 is moved further into cylinder 10 such that piston head 27 passed by vent hole 16 in the side wall of cylinder 10 and results in complete containment of air inside cylinder 10 since piston head 27 is sealed by first O-ring 70. Continued pushing force 201, as described, presses piston head 27 through cylinder 10 and compresses all air trapped into cavity 29 inside piston 20 as piston head 27 nears the closed end 11 of cylinder 10. In this way, the volume of space for the air trapped inside cylinder 10 as described has been greatly reduced and its pressure has been elevated above ambient.

As piston 20 finishes its movement fully into cylinder 10, latch prongs 25 come into interference with the inner diameter 66 of bushing 60, which causes them to flex inward and pass through bushing 60. As latch prongs 25 clear the upper side 61 of bushing 60 they are no longer constrained in their flexed position and snap back to their natural position. This occurs at the same time that piston head 27 reaches its uppermost position. The user can no longer push piston 20 into cylinder 10, and upon hearing the snap sound of the latch prongs 25 clearing bushing 60, the user stops pushing on piston 20 and releases pressure 201 on hand knob 40. The release of hand pressure 201 on hand knob 40 allows the air pressure held in cylinder 10 to push piston 20 back toward bushing 60. Latch prongs 25 cannot pass back through the inner diameter 66 of bushing 60 and come to rest on the upper surface 61 of bushing 60, as shown is FIG. 4, and therefore hold piston 20 inside cylinder 10 when all hand pressure 201 is removed from hand knob 40.

Figure 3:
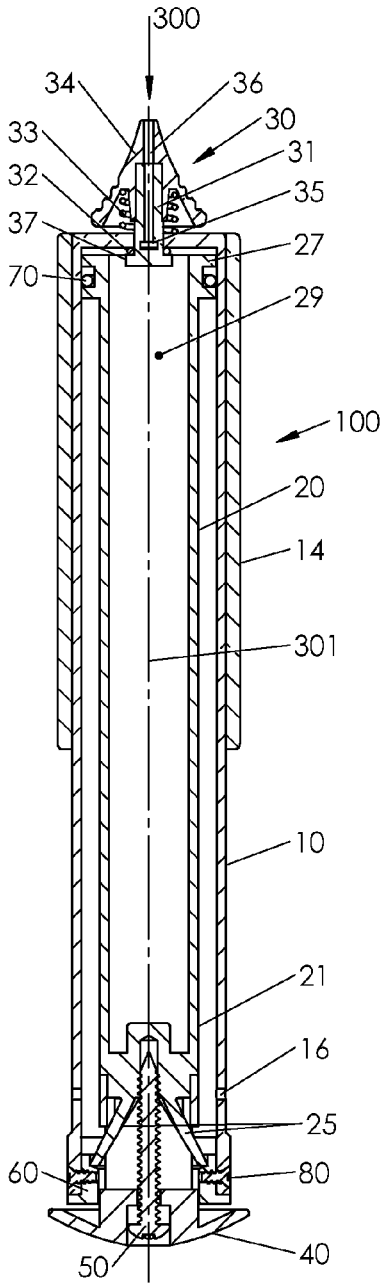
FIG. 3 is a cross-sectional view of the handheld nozzle cleaning apparatus of FIG. 1.

Referring to FIG. 3, the handheld nozzle cleaning apparatus 100 now has air under pressure held within the inner cavity 29 of piston 20 ready to be released into the liquid application nozzle that requires debris to be cleared. Valve and nozzle 30 is used to release this compressed air. The user releases the compressed air by pressing in direction 300 on nozzle 34. This force causes spring 33 to be compressed and moves valve stem 31 through a hole 13 in cylinder 10. Second O-ring 32 is attached to valve stem 31, and therefore moves away from the inner surface of the closed end 11 of cylinder 10 and allows the compressed air to flow through passage 35 in valve stem 31, and into the passage 36 in nozzle 34. The air then exits nozzle 34, and is directed toward the liquid application nozzle being cleaned.

Now referring to FIG. 3-6, cylinder 10 is described in more detail. Cylinder 10 has an open end 12 and a closed end 11. Closed end 11 has the hole 13, which allows attachment and function of valve and nozzle 30. Open end 12 is sized to accept a pressure-tight fit of piston head 27 when first O-ring 70 is installed into grove 23. The length of cylinder 10 is selected to allow complete insertion of piston 20 including piston rod 21 and latch prongs 25. The open end 12 of cylinder 10 is also sized to accept bushing 60, with a means to attach bushing 60 to cylinder 10, as shown in FIG. 3-5. Attachment of bushing 60 to cylinder 10 may be accomplished using glue, sonic welding, screws or pins. A particular embodiment 100 uses screws 80 to attach bushing 60 to cylinder 10. Cylinder 10 also has a hand grip area 14, which allows for a better grip by the user during operation. Cylinder 10 may be constructed of metal, plastic, or other suitable material. In a particular embodiment, cylinder 10 is constructed of molded plastic. It is noted that other methods of manufacture including machining will also suffice. It is also noted that hand grip 14 may be a separate piece, and not molded or fabricated as part of cylinder 10.

Piston 20 is now described in more detail with reference to FIG. 3-6. Piston 20 has a piston head 27 at one end, sized to fit inside cylinder 10 with an air-tight seal when first O-ring 70 in installed in grove 23. Piston head 27 is connected to piston rod 21 which contains cavity 29 that is open to the top of piston head 27. Latch prongs 25 are attached to the opposite end of piston rod 21 of piston 20 and become a part of latch mechanism 400. Latch mechanism 400 is comprised of latch prongs 25 which may be flexed inward during use.

The length of piston 20 is selected to fit completely inside cylinder 10 when bushing 60 is installed such that latch prongs may rest on the upper surface 61 of bushing 60. Piston 20 may be constructed of metal, plastic, or other suitable material. In a particular embodiment, piston 20 is constructed of molded plastic. It is noted that other methods of manufacture including machining will also suffice. The thickness of latch prongs 25 is selected based on the material piston 20 is manufactured from, with a goal of allowing flexing of the latch prongs 25, as described above, but still allowing them sufficient rigidity to withstand the forces required to hold piston 20 inside cylinder 10 when compressed air is being held inside cavity 29 and above piston head 27.

Referring to FIGS. 3-6, hand knob 40 is described in more detail. Hand knob 40 has a large outer diameter portion sized to exceed the outer diameter of cylinder 10 such that it allows the user a place to grip when exerting pulling force 200. Hand knob 40 also has a smaller diameter portion 41 that is sized to fit inside the inner diameter 66 of bushing 60. Side openings 42 on hand knob 40 are sized to allow latch prongs 25 to pass through. During application of pulling force 200, edges 43 of hand knob 40 come in contact with latch prongs 25 and cause them to flex inward, as shown in FIG. 5. When pushing force 201 is applied to hand knob 40, edges 43 are released from contact with latch prongs 25 and therefore allow them to return to their natural un-flexed position, as shown in FIG. 4.

A central hole 44 and recess 45 allow screw 50 to pass through hand knob 40. During use, hand knob 40 slides back and forth on screw 50 and shoulder 22 of piston 20 to allow operation of the latch mechanism. Recess 45 keeps the head of screw 50 from protruding beyond the surface of hand knob 40, thus allowing for a projection free surface for the user to apply hand pressure 201 without discomfort. Hand knob 40 may be constructed of metal, plastic, or other suitable material. In a particular embodiment, hand knob 40 is constructed of molded plastic. It is noted that other methods of manufacture including machining will also suffice.

Referring to FIGS. 4 and 5, screw 50 is now described in greater detail. Screw 50 is sized to fit through hole 44 in hand knob 40 without interference. The head of screw 50 is sized to fit into recess 45 of hand knob 40. The length of screw 50 is selected to allow engagement of screw 50 into hole 24 in piston rod 21 such that when properly engaged in hole 24, hand knob 40 is allowed to slide from a compressed position as shown in FIG. 4 to an extended position as shown in FIG. 5. Screw 50 may be of self threading type so no pre-forming of mating threads in hole 24 are required prior to assembly. It is further understood that screw 50 may be some other type of fastener such as bolt, press fit rod, or pin and serve the same function as screw 50. Screw 50 may be constructed of metal, plastic or other suitable material. In the preferred embodiment screw 50 is constructed of metal and is self-threading.

In reference to FIG. 3-6, bushing 60 is now described in more detail. The outside diameter of bushing 60 is sized to fit inside cylinder 10 at the open end 12. A means of attaching bushing 60 inside cylinder 10 is applied which may include gluing, ultrasonic welding, heat welding, or use of fasteners such as screws, pins or bolts. The inside diameter 66 of bushing 60 is sized to allow an interference-free slide of piston rod 21, but such that latch prongs 25 will have to be flexed inwards to allow their passage through bushing 60. The upper surface of bushing 60 contains a recess 62 with a diameter larger than the diameter of the inside diameter 66 but smaller than the outside diameter of bushing 60. The diameter of recess 62 matches the effective outside diameter of the tips 26 of latch prongs 25.

As latch prongs 25 come in contact with surface 61 of recess 62, they are restrained from increasing their effective outside diameter which may result from the force required to retain piston 20 inside cylinder 10 when air is compressed and held in chamber 29 and above piston head 27. Bushing 60 may contain a means of easing assembly to cylinder 10 by providing a stopping lip 63 to assure proper assembly of bushing 60 fully into cylinder 10 such that the recess 62 and surface 61 are located at the proper distance from the closed end 11 of cylinder 10 in reference to the total length of piston 20. Bushing 60 may be constructed of metal, plastic or other suitable material. In certain embodiments, bushing 60 is constructed from injection molded plastic. It is noted that other methods of manufacture including machining will also suffice.

Figure 6:
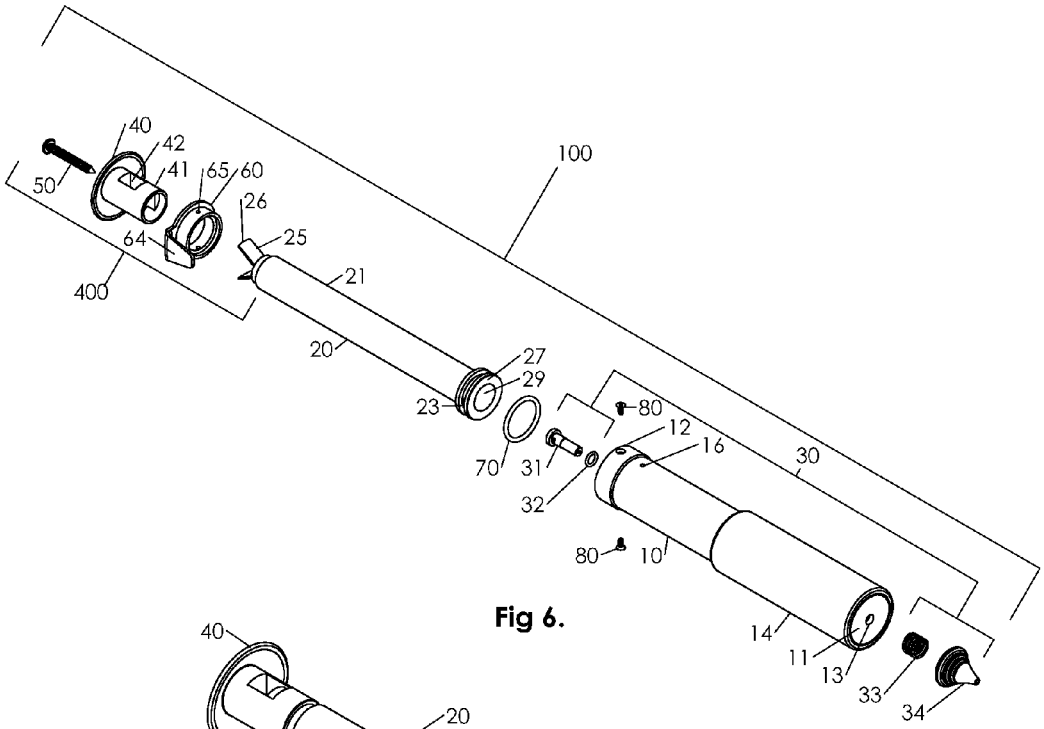
FIG. 6 is an exploded view of the handheld nozzle cleaning apparatus of FIG. 1.

Now referring to FIGS. 3 and 6, valve and nozzle 30 is described in more detail. Valve and nozzle 30 consists of nozzle 34, valve stem 31, second O-ring 32, and spring 33. Valve stem 31 is sized to fit into hole 13 in the closed end of cylinder 10 with enough clearance to allow free movement but tight enough to limit air leakage when valve and nozzle 30 is activated by the user. A boss 37 of increased diameter is part of valve stem 31 to provide retention of second O-ring 32 when pressure is applied by spring 33 to hold valve and nozzle 30 closed.

Nozzle 34 has several features. First, it has an inner diameter sized to match the outer diameter of valve stem 31. The clearance or interference of this fit is selected to allow permanent attachment of nozzle 34 to valve stem 31 by either gluing, welding, press fit, or threads or a combination thereof. The result is that, when assembled, nozzle 34 is fixed to valve stem 31 so that pressure from spring 33, or finger pressure in the direction of 300, will close or open valve and nozzle 30, respectively. Valve stem 31 contains passage 35 which is exposed to the compressed air inside cylinder 10 when the valve and nozzle 30 is fully activated by finger pressure in the direction 300.

Passage 35 is aligned with passage 36 in nozzle 34, thus allowing compressed air to exit nozzle 34 when valve and nozzle 30 is activated by the user. When finger pressure is released or not present in the direction 300, spring 33 applies a force that pushes nozzle 34 away from the closed end 11 of cylinder 10, which by means of their permanent attachment causes the boss 37 of valve stem 31 to be pulled against second O-ring 32 thus sealing second O-ring 32 between the inside surface of the closed end 11 of cylinder 10 and the boss 37 of valve stem 31. In this way, air compressed inside cylinder 10 may not exit valve and nozzle 30 when in the closed position, as shown in FIG. 3. Valve and nozzle 30 may be constructed of metal, plastic or other suitable materials. In a particular embodiment, nozzle 34 and valve stem 31 are constructed injection molded plastic. In certain embodiments, spring 33 is constructed of metal and is a compression type spring, while second O-ring 32 is constructed of rubber. It is noted that other methods of manufacture including machining will also suffice for nozzle 34 or valve stem 31.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A handheld nozzle cleaning device comprising:

a cylinder and piston disposed within the cylinder, the piston being movable between a latched position, in which air is compressed, and an unlatched position, in which air is drawn into the cylinder;

a valve and a nozzle disposed at one end of the cylinder;

wherein manual operation of the piston, defined by linear movement of the piston in a first direction, both releases the piston from the latched position and draws air into the cylinder; and wherein the compressed air flows out of the cylinder through the nozzle when the valve is opened.

2. The handheld nozzle cleaning device of claim 1, wherein manual operation of the piston, defined by linear movement of the piston in a second direction opposite the first direction, both compresses air within the cylinder and secures the piston in the latched position.

3. The handheld nozzle cleaning device of claim 1, wherein a spring biases the valve in a closed position.

4. The handheld nozzle cleaning device of claim 3, wherein the cylinder, valve, spring, and nozzle are all aligned axially, and wherein the valve is opened when a force sufficient to overcome the biasing force of the spring is applied to the nozzle in the axial direction.

5. The handheld nozzle cleaning device of claim 4, wherein the cylinder has an opening at the one end, the nozzle having a valve stem, configured to move within the opening, and a boss configured to cover the opening when the valve is in the closed position.

6. The handheld nozzle cleaning device of claim 5, wherein the nozzle has a passage that permits a flow of air from the valve stem out through an end of the nozzle when the valve is in the open position.

7. The handheld nozzle cleaning device of claim 5, wherein the opening, valve stem, and boss are centered on a longitudinal axis of the cylinder and piston.

8. The handheld nozzle cleaning device of claim 1, wherein the cylinder has one or more openings therein, and wherein manual operation of the piston draws air from outside of the cylinder through the one or more openings into the cylinder.

9. The handheld nozzle cleaning device of claim 1, wherein the piston is hollow, and wherein manual operation of the piston compresses air within the piston.

10. The handheld nozzle cleaning device of claim 9, wherein the piston includes a piston head that forms an air-tight seal within the cylinder.

11. The handheld nozzle cleaning device of claim 10, a vent hole in the cylinder allows for air into the cylinder when the piston head is not sealing against the vent hole.

12. The handheld nozzle cleaning device of claim 10, wherein the air-tight seal is maintained by an O-ring inserted into a groove in the piston head.

13. The handheld nozzle cleaning device of claim 1, wherein the cylinder includes a latching mechanism configured to keep the piston in place when compressed air is in the cylinder.

14. The handheld nozzle cleaning device of claim 13, wherein the latching mechanism comprises a hand knob, a bushing, and latching prongs attached to an end of the piston, wherein the hand knob is adapted to operate the piston for compressing air in the cylinder.

15. The handheld nozzle cleaning device of claim 14, wherein the latching prongs are configured to be flexed inward by movement of the hand knob, and also configured to extend through an opening in a cylindrical portion of the hand knob such that the latching prongs contact a portion of the bushing to keep the piston in place.

16. The handheld nozzle cleaning device of claim 13, wherein the bushing is attached to an end of the cylinder opposite the end with nozzle.

17. The handheld nozzle cleaning device of claim 1, wherein the piston is sized to fit completely inside of the cylinder when air is compressed in the piston.

* * * * *